United States Patent [19]

Martin

[11] 4,446,847

[45] May 8, 1984

[54] FIREPLACE OUTSIDE AIR INLET

[76] Inventor: Charles A. Martin, Chisholm Rd., Kingston, N.H. 03848

[21] Appl. No.: 366,041

[22] Filed: Apr. 6, 1982

[51] Int. Cl.[3] ..... F22B 9/02

[52] U.S. Cl. ..... 126/120; 126/285 A; 126/288

[58] Field of Search ..... 126/76, 120, 77, 121, 126/143, 163 R, 292, 295 R, 293, 288, 285 A

[56] References Cited

U.S. PATENT DOCUMENTS

| | | | |
|---|---|---|---|
| 37,781 | 2/1863 | Turner | 126/295 |
| 613,781 | 11/1898 | Schneider | 126/77 |
| 811,199 | 1/1906 | Calhoun | 126/77 |
| 948,007 | 2/1910 | Doane | 126/120 |
| 2,740,398 | 4/1956 | Collins | 126/143 |
| 4,248,206 | 2/1981 | Orthey, Jr. | 126/143 |

*Primary Examiner*—James C. Yeung

*Attorney, Agent, or Firm*—Lee A. Strimbeck

[57] ABSTRACT

A draft inlet or control for admitting outside air to a fireplace comprises a conduit sized to be set in and through the brickwork of a fireplace, preferably in the rear wall. The end facing into the fireplace has a face plate with radially spaced openings therein over which is a finger or poker operable rotatable shutter having like radially spaced openings permitting closing of the draft inlet when the two sets of openings are out of register. In one design, the shutter is held in place by a top plate spot welded to flanges on the conduit and having a circular opening with a restraining lip stamped in the edge of the opening to hold the shutter. In another design, the end plate and shutter are cast of a metal such as case iron, aluminum or brass and are held together and to the conduit by suitable fastening means, a top plate not being required.

3 Claims, 5 Drawing Figures

FIREPLACE OUTSIDE AIR INLET

INTRODUCTION

This invention is a draft inlet for supplying outside air to a fireplace. It is characterized by the fact that it is of a size and of such rugged construction that it can safely be built into the back wall or floor of a fireplace during construction.

As is known, unless means for supplying outside air to a fireplace is provided, a fireplace will withdraw considerable heated air from the room and exhaust it through the chimney. This makes the fireplace less efficient as the air taken from the room must be replaced by cold air from outside the room and this tends to lower the temperature of the room below what it might otherwise be.

Reference is made to U.S. Pat. Nos. 3,180,322 (Grushkin) and 4,184,474 (Pulliam et al) which are addressed to this problem and provide a like solution except that the draft control means of these patents are structurally substantially different from what is proposed herein.

In brief compass, the present invention is a draft inlet for a fireplace comprising a conduit; a face plate affixed thereon having a series of apertures equally radially spaced about an axis of rotation in its central portion within the area defined by the walls of said conduit; a circular plate mating with the face plate and rotatable thereover, the circular plate having a like series of apertures registering with those of the face plate when in alignment and when not in alignment preventing the passage of air through the end plate; and a projecting lug from the circular plate functioning to permit rotation of the circular plate by hand or with a poker.

In one embodiment, the circular plate is held in position by a top plate having a central circular opening mating with and holding the circular plate, the central circular opening having outwardly projecting lugs or a raised retaining lip for this purpose.

In another embodiment, the face and circular plate are cast metal, with the face plate having a central circular recess to receive the circular plate, the latter being mounted to the face plate by a screw or bolt at the axis of rotation.

THE DRAWINGS

DESCRIPTION

Figure 1:
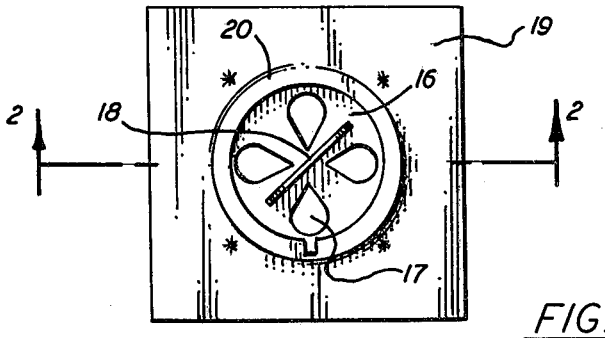
FIG. 1 is a front view of one design of the inlet damper of this invention, which includes a top plate to retain the shutter.
Figure 2:
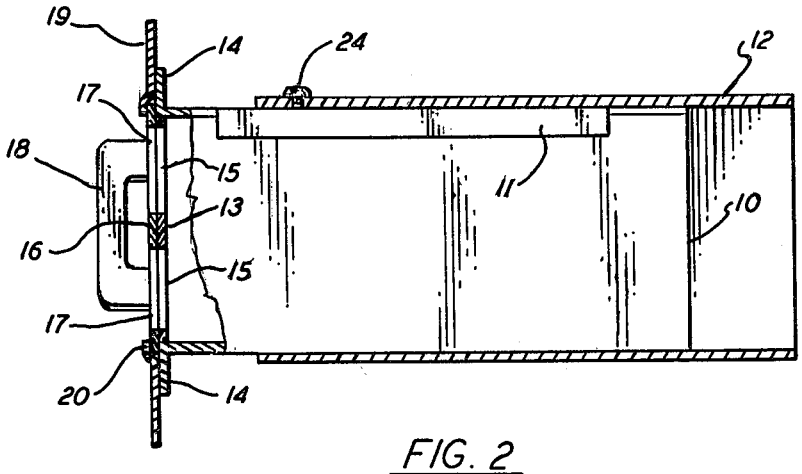
FIG. 2 is a side sectional view taken along line A—A of FIG. 1.
Figure 3:
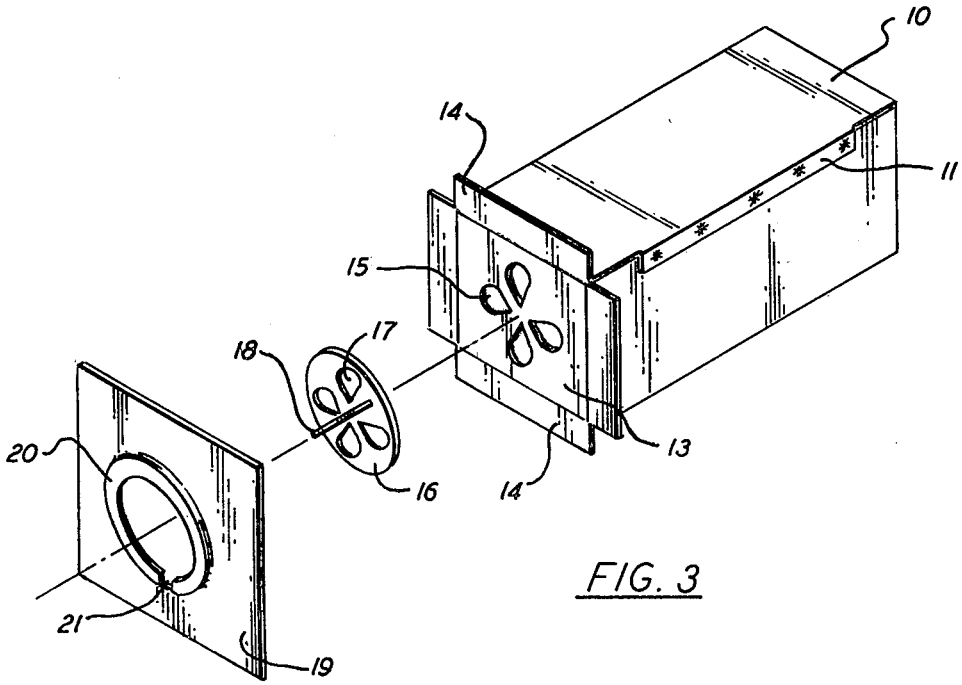
FIG. 3 is an exploded view showing the assembly of the air inlet for FIG. 1.

In FIGS. 1-3, 10 is a sheet steel plate preferably at least 1/16 inch thick rolled into a rectangular tube, preferably a square about 3-3½ inches on its side that will fit into the brickwork pattern of a fireplace. In making the rectangular tube one end of the plate 11 is overlapped as shown an inch or so and spot welded.

The end of piece 11 facing the open end of the tube is cut back 3 or 4 inches, also as illustrated, to permit the insertion in the end of tube 10 of suitable tinwork or ducting if it is necessary to secure the air inlet to a source of outside air.

Tube 10 can be associated with a like mating tube 12 that telescopes over tube 10 to permit extension of the air inlet through a thick course of brickwork. A set screw 13 or the like may be used to hold tube 12 in place with respect to tube 10. Tube 12 is not illustrated in FIG. 3.

Tube 10 has outwardly turned flanges 14 formed by bending back the edges of the tube. Welded within the end of the tube is a face plate 13 having a series of radially spaced apertures 15 in it. A circular shutter 16 with like mating radially spaced apertures 17 fits loosely over the apertures 15 on face plate 14. Apertures 17 are preferably teardrop shape with the narrow portions of the teardrop pointing to the axis of rotation. Shutter 16 has a small handle 18 to permit rotation of the shutter by hand or with a poker.

Shutter 16 is held in place by an end plate 19 having a circular opening that mates with shutter 16. End plate 19 is spot welded to flanges 14.

Plate 19 has a raised retaining lip 20 stamped into it to hold shutter 16 in place. Shutter 16 can also be held in place by coining into the edges of the opening in plate 19 encompassing the shutter slight restraining lugs or projections that extend up and over shutter 16 to hold it within plate 19 while allowing it to be freely rotated. Lip 20 can have an ⅛ inch or so wide slot 21 cut into it to permit ash and other debris to work free.

Figure 4:
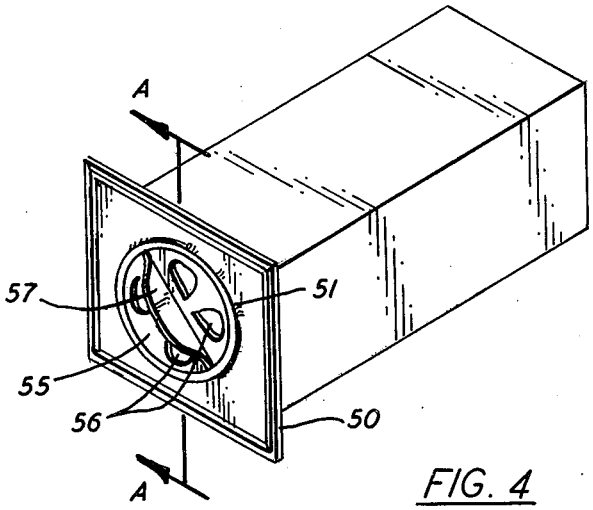
FIG. 4 is a perspective view of another design of the draft inlet of this invention wherein the face plate and shutter are case metal and no top plate is required.
Figure 5:
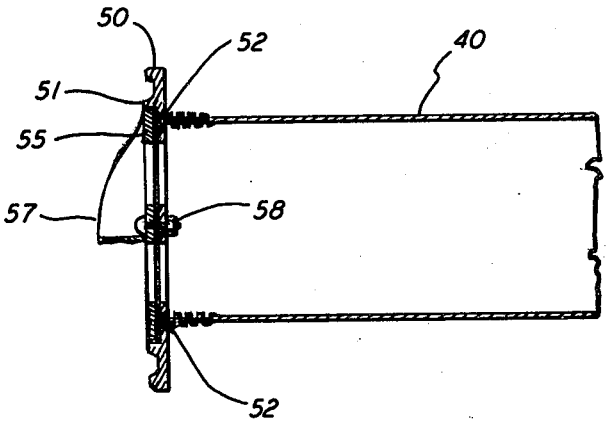
FIG. 5 is a sectional view taken along line A—A of FIG. 4.

Referring to FIGS. 4 and 5, face plate 50 is of a cast metal such as cast iron, brass or aluminum, as is the circular shutter 55 with its projecting lug or handle 57. Face plate 50 has a recess cast therein, defined by lip 51 about the circular opening, which circular opening mates with shutter 55. The apertures in shutter 55 are shown at 56. Shutter 55 is mounted to face plate 50 at its axis of rotation by a fastening means or bolt 58. Face plate 50 is mounted to conduit 40 by recessed screws 55 that enter into bores in corrugations or expansions placed in the end of conduit 40 for that purpose. Four fasteners 55 are usually sufficient.

The present inlet is preferably placed in the back wall of a fireplace with its bottom edge at the level of the fireplace floor. Alternatively, it may be placed facing upwardly in the front edge of a fireplace floor and be connected to a source of outside air in the manner illustrated in FIG. 2 of U.S. Pat. No. 4,184,474.

Besides being used with open fireplaces, this invention can be usefully applied to stove installations, especially those that are set on a brick hearth and/or surrounded by brick walls for safety. The air inlet can be used to supply air to the area of the stove so that the stove does not have to create cold air drafts in the room itself to secure combustion air, i.e., the air inlet equalizes the pressure inside the room with that of the outside air.

What is claimed is:

1. A fireplace inlet comprising: a square conduit having a flange at one end; a face plate affixed at said one end, said face place having a series of apertures within the area defined by the walls of said square conduit and equally radially spaced about the axis of rotation of said face plate; a circular plate of a size to encompass said apertures and lie within said area, said circular plate being mounted for rotation on said face plate and having a series of apertures registering with those of said face place when in alignment and when not in alignment preventing the passage of air through said face plate; a top plate over said circular plate and affixed to said flange, said top plate having a central circular opening therein mating with and accommodating said circular plate and having a lip on the edge of said central circular opening holding said circular plate for rotation; and an outwardly projecting lug affixed to said circular plate to affect rotation thereof by hand or by a poker.

2. The fireplace draft inlet of claim 1 wherein said aperture comprise 4 teardrop shape openings with the narrow portion of the teardrops pointing to said axis of rotation; wherein said square conduit is in the range of 3 to 3½ inches on the side and said flange is formed by turning out at right angles at said one end the walls of said conduit and wherein said face plate is affxed to said flange by spot welding.

3. The fireplace draft inlet of claim 2 including a mating telescoping outer square sleeve about said square conduit that permits the length of said conduit that permits the length of the conduit passageway to be adjusted.

* * * * *